US010315199B2

(12) United States Patent
Rose

(10) Patent No.: US 10,315,199 B2
(45) Date of Patent: Jun. 11, 2019

(54) METHOD FOR COLLECTION OF INTEGER GLANDULAR TRICHOMES

(71) Applicant: Mark Jeffery Rose, Golden, CO (US)

(72) Inventor: Mark Jeffery Rose, Golden, CO (US)

( * ) Notice: Subject to any disclaimer, the term of this patent is extended or adjusted under 35 U.S.C. 154(b) by 0 days.

(21) Appl. No.: 15/666,234

(22) Filed: Aug. 1, 2017

(65) Prior Publication Data

US 2019/0039074 A1 Feb. 7, 2019

(51) Int. Cl.

| | |
|---|---|
| ***B03B 5/00*** | (2006.01) |
| ***B03B 5/48*** | (2006.01) |
| ***B05B 13/02*** | (2006.01) |
| ***B05B 13/04*** | (2006.01) |

(52) U.S. Cl.

CPC ..... *B03B 5/48* (2013.01); *B05B 13/0278* (2013.01); *B05B 13/04* (2013.01); *B07B 2201/04* (2013.01)

(58) Field of Classification Search

CPC ..... B07B 2201/04; B07B 2230/01; B05B 13/0278; B05B 13/04; D01B 1/00; D01B 1/30; D01B 1/42; B03B 5/00; B03B 7/00; B03B 11/00

USPC ..... 209/268, 454, 458, 489, 500

See application file for complete search history.

(56) References Cited

U.S. PATENT DOCUMENTS

| | | | | |
|---|---|---|---|---|
| 5,429,247 | A * | 7/1995 | Lemay | B07B 1/00 209/17 |
| 6,158,591 | A * | 12/2000 | Delp | B01D 11/0257 209/17 |
| 6,672,462 | B2 * | 1/2004 | Sharkey | B01D 29/01 210/409 |
| 6,800,319 | B1 * | 10/2004 | Hulst | D01B 1/42 162/24 |
| 7,438,188 | B2 * | 10/2008 | Stolworthy | B03B 5/04 209/13 |
| 7,685,767 | B2 * | 3/2010 | Timmis | A01H 1/04 47/57.6 |
| 8,808,501 | B2 * | 8/2014 | Vinson | D21H 11/12 162/117 |
| 9,050,631 | B2 * | 6/2015 | Raichart | B07B 1/288 |
| 9,688,953 | B2 * | 6/2017 | Swanda | C12M 47/04 |
| 2013/0079531 | A1 | 3/2013 | Barringer | |
| 2016/0160439 | A1 * | 6/2016 | Mohammadi | D21F 11/00 162/109 |
| 2017/0321350 | A1 * | 11/2017 | Heger | D01B 1/42 |

OTHER PUBLICATIONS

Yerger, Ellen H., "A Rapid Method for Isolating Glandular Trichomes," Plant Physiology, 1992, 99, 1-7.

* cited by examiner

*Primary Examiner* — Joseph C Rodriguez
(74) *Attorney, Agent, or Firm* — Haug Partners LLP

(57) ABSTRACT

Process to produce integer glandular trichomes from resin rich plants, comprising the steps of dislodging the integer glandular trichomes from the plants by the means of a pressurized cold water jet, and sieving the resulting water flow across a series of sieving screens being in a progressively decreasing hole size order.

20 Claims, 2 Drawing Sheets

METHOD FOR COLLECTION OF INTEGER GLANDULAR TRICHOMES

FIELD OF THE INVENTION

This disclosure relates generally to the production of pure integer glandular trichomes from all plants bearing glandular trichomes, and more specifically to the production of >96% pure integer glandular trichomes as resin from Cannabis plants.

BACKGROUND

Most plants have specialized hair-like trichomes structures on leaf surfaces, non-glandular trichomes being very common, glandular trichomes being less common. Glandular trichomes are a mixture of waxes, resins and oils capable of storing relatively large amounts of secondary metabolites, like terpenoids, as part of the "essential oil" of the plant, making them a target for the production of valuable small molecules.

For example, peppermint oil, consisting primarily of monoterpenes from glandular trichomes and minor quantities of sesquiterpens are synthesized and accumulated in specialized non-glandular trichomes pistils, hairs of the peppermint plant and essentially natural oils are extracted with heat and solvent are in common use as a flavor in numerous consumer products (e.g., chewing gum, mouthwash . . . ), in the confectionary and pharmaceutical industries as well.

Whereas since the distant past, 8000 B.C. up the present, Cannabis in various forms was either eaten or smoked, the major usage being a recreational drug all over the world, cannabinoids and their derivatives were the mainstay of early medicine and the seeds were integrated into most every cuisine around the world, Cannabis products have been consumed in various forms for thousands of years. Descriptions of medical uses in Chinese texts date from the first century A.D., disclosing oral consumption in herbal tea concoctions, used for pain relieving and sleep inducing. The use of cannabis in Hindu India was largely popularized by Shiva smoking the leaf or resin extracts for their psychoactive properties. The use was spread through Arab lands in the Middle Ages, before coming into Europe and the Americas. For centuries, Cannabis resin was made by hand rubbing the flowers or sifting with fine cloths as screens.

Cannabinoids are receiving just recently a new and increasing interest again for recreational freedom, State taxes, nutrition and pharmaceutical, commercial and industrial purposes.

In comparison to other parts of the plant, the integer glandular trichomes of the Cannabis Indica plants store the highest concentrated amounts of cannabinoids, in particular tetrahydrocannabinol (THC) and cannabidol (CBD). Almost all current research focuses either on genetically engineered plants exhibiting enhanced contents of THC, CBD or other molecules, or on medical applications of particular cannabinoids. The known extraction methods are usually dedicated to isolate a specific molecule and thus involve a solvent. For example, US 2013/0079531(to Barringer) teaches an ethanol extraction at −20° C.

There is to our knowledge very few methods to produce pure integer glandular trichomes.

U.S. Pat. No. 6,158,591 (to Delp) uses cold water and ice in a wash process to cause the resins to become brittle, while the remaining plant material becomes more flexible. Separation is accomplished using an ICE COLD® extractor apparatus having a washing chamber disposed above a settling chamber and a collection bottle placed below the settling chamber.

A re-interpretation of this process patent is a licensed device comprising of four or eight sieving bags of different mesh size for separating resin particles from various plant materials may be found for example under the name of "Bubble-Bags®".

One drawback of the ice-water methods is that some valuable aromatic and sticky components of the resin material, the terpenes and light oils, are lost by dissolution in the water. Another drawback of these methods is that the resin is saturated for minimum one hour in water and must be quickly, carefully and thoroughly dried thereafter to avoid deterioration by fungal growth under moisture. These drawbacks may lead to an alteration or degradation of the organoleptic properties of the targeted integer glandular trichomes resin.

A dry process is known from the publication of Yerger et al, Plant Physiology, 1992, 99, 1-7, wherein, deep frozen plant material is placed together with crushed dry ice (CO2) in a vortex mixer. Glandular trichomes are then separated by sieving. This paper teaches that the dry ice particles act mechanically to separate trichomes from pistils. A corresponding device may be commercially available under the name of "Tumble Now®". Such device comprises a sifting drum accommodating the plant material, tumbling inside a casing, so that the finer fraction of particles fall through the screen around the drum onto the bottom of the casing for later collection. The process is extremely sensitive to the operating parameters such as the temperature, the humidity and the process duration. A very cold and dry atmosphere is required, and short processing time is necessary to recover the resin with a higher purity. Under these conditions, the yield is low.

SUMMARY OF THE INVENTION

The aim of the present invention is to provide a method of extraction together with a method of collection resulting in a lesser degree of the above drawbacks. In particular, it is the aim of the present invention to provide a processing method which results both in a high yield per hour of extraction processing and a high purity of the integer glandular trichomes in the collection process. An extraction method, or process, is hereby understood as a series of steps through which the integer glandular trichomes are removed from a raw plant material and suspended in water. The extraction method according to the present invention is an extraction process using an aqueous solvent flow. A collection process is hereby understood as a process to isolate the glandular trichomes from the remaining components resulting from the extraction steps. The collection process according to the present invention involves successive sieving steps to isolate the integer glandular trichomes according to their size.

Any resinous plant comprising glandular trichomes may be involved in the extraction and collection process of the present invention, such as cannabis, rose, or lavender and the result will be pure integer resin glands. The plants may be involved in the extraction process as dried or desiccated material, or as fresh cut plants. The complete plant material may be involved in the process, or only parts of the plants such as the leaves, the flowers, or the stems. The plants may be made into small elements before being processed or kept entire.

In one aspect, the present invention is directed to a method or process for extracting the integer glandular trichomes from a resin gland bearing plant material with the flow of high pressure cold water. The apparatus is provided with a means for delivering pressurized cold water.

In another aspect, the present invention is directed to a method or process for collecting glandular trichomes suspended in a resin rich water flow.

In another aspect, the present invention is directed to an apparatus adapted for extraction and collection of the integer glandular trichomes suspended in a resin rich water flow. The apparatus is in particular provided with several sieving means for isolating the integer glandular trichomes according to their size.

DETAILED DESCRIPTION OF THE INVENTION

Figure 1:
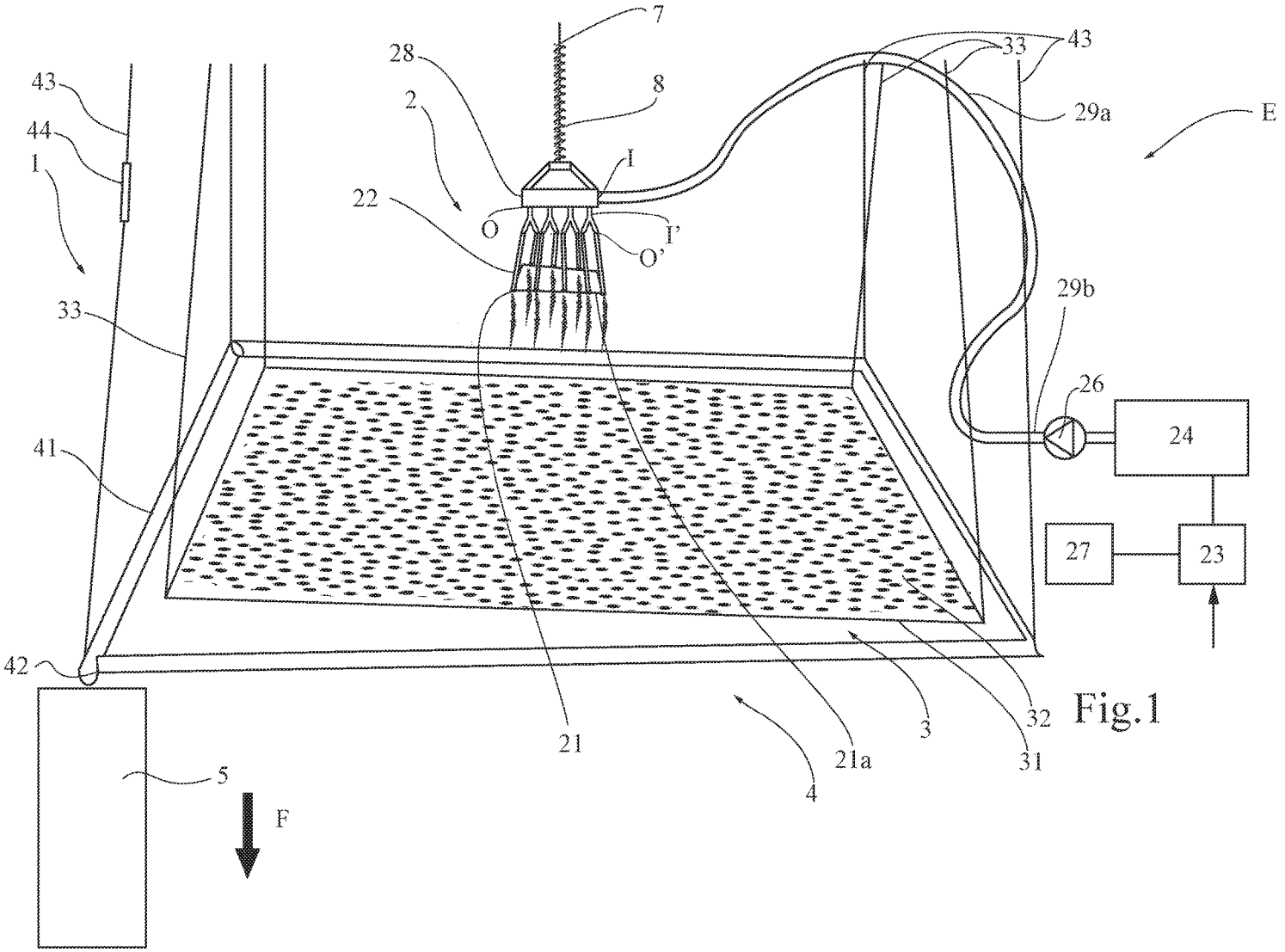
FIG. 1 shows an example of the spray extraction apparatus according to the present invention.

The present invention is directed to an apparatus comprising an extraction unit E, and a collection unit C. The extraction unit E comprises a spray-array 2 and a spray-table 3. The spray-array 2 is suspended above the spray-table 3. It comprises several nozzles 21 fed with pressurized cold water. The nozzles 21 are preferably disposed on a nozzle frame 21*a*. The nozzle frame 21*a* may be fixed to a manifold 28 or directly attached with rigid ducts 22. Alternatively, the nozzle frame 21*a* may be connected to a manifold 28 only through the ducts 22. A duct 22 branched to each nozzle 21 supplies the refrigerated and pressurized water to the corresponding nozzle 21. The ducts 22 are connected to a manifold 28, which is fed by a flexible hose 29*a*. A pump 23 and refrigerated pressurized expansion-tank 24 may be used to prepare the necessary amount of water before it is supplied to the manifold 28. The usual domestic water distribution can be used to supply the pump 23.

A water temperature comprised of between 0.5° C. and 2° C., and ideally around 1° C., is preferred for this extraction. Preferably, the same temperature is maintained through the collection process.

The pressure of the cold water at the spray level is advantageously comprised between around 1.5 and 3.5 bars, preferably between 2 and 3 bars, and ideally at 2.5 bars.

A trunk line 29*b* may be used to supply the pressurized cold water to the flexible hose 29*a* from the refrigerated pressurized holding tank 24. The tank 24 may be used, in such a way that a predetermined amount of water is conditioned and stored before the process is triggered. The pressurized tank 24 may be refrigerated, by the means of usual refrigerating systems in such a way that the water stored within the pressurized tank 24 is maintained at 2.5 bar and a temperature close to 1° C. Multiple tanks 24 might be required for continuous work.

When working in a hot environment the delivery hose 29*a*, the manifold 28 and the individual ducts 2, may alternatively be embedded within a refrigerated area, not shown, so as to help maintain the water at the preferred temperature comprised between 0.5° C. and 2° C. during process.

The manifold 28 collects the pressurized water from the hose 29*a* and distributes it to the nozzles 21 through the ducts 22. The manifold has thus one input I and several outputs O. The number of outputs O may be equal to the number of nozzles 21 in such a way that each output O is connected to a nozzle 21 through a linear duct 22. A duct 22 designates a duct connected from one output O of the manifold 28 to one input at the nozzle 21. Alternatively, the number of outputs O on the manifold 28 may be less than the number nozzles 21. In this configuration, the pressurized water is fed to the nozzles 21 through branched ducts 22, as shown in FIG. 1. The output O may also arrive to the nozzle 21 following a combination of linear and branched ducts 22, providing the even flow of adequate pressure is not compromised.

The connection of the ducts 22 to the outputs O of the manifold 28 and to the nozzles 21 is performed by any usual fluidic connection means, such as tightening the extremity of the duct 22 onto a protruded shape of the manifold 28 and the nozzles 21, or screwing or clipping together the two parts of a two-part connector. Alternatively, the ducts 22 may be integral to the manifold 28 and the nozzles 21, in such a way that the spray-array 2 forms a single element of the apparatus 1. The ducts 22 may be made of any rigid material such as metal or hard plastic material. They can alternatively be made of any usual flexible material, such as rubber, soft polymers, and any combination of flexible materials adapted to resist an internal pressure of up to 3.5 bars.

The spray-array 2 is placed in such a way that the nozzles 21 are oriented to direct the corresponding water jets downwards, in direction to the spray-table 3. The number of nozzles 21 and the dimensions of the spray-array 2 may vary depending on the usage. A spray-array 2 of 0.2 square meters (40 cm by 50 cm) up to 0.4 square meters (50 cm by 80 cm) can comprise for example 20 to 40 nozzles 21. The nozzles 21 are preferably dispatched on the spray-array 2 in a regular and homogenous manner, which is to say that the nozzle 21 are spaced from each other by an equal distance or a substantially equal distance.

As an example, a spray-array 2 can comprise 25 nozzles 21, arranged on 5 rows of 5 wherein the distance between the nozzles 21 is constant and equal to around 10 cm. Other specific arrangements may be contemplated. The spray array 2 may for example comprise only 17 nozzles 21, at any rate dispatched on a rectangular frame, which is preferably made of flat aluminum slats.

The nozzles 21 can be calibrated to provide a cone shaped water jet towards the spray-table 3. Alternatively, a flared water shaped jet can be provided by the nozzles 21 in order to impact a specific operator targeted area on the spray-table 3. The nozzles 21 may optionally be provided with a regulation means, not shown, to modify the shape of the water jet. A regulation means may for example comprise a screwed ring at the extremity of the corresponding nozzle 21, which can be screwed or unscrewed to enlarge or reduce the nozzle aperture, and thus modify the shape of the water jet. Any other known water jet regulation means may be used. In any case, the pressure of the water supplied to the nozzles 21 is adapted to impact the spray-table 3 with sufficient strength to dislodge the resinous components, including the integer glandular trichomes of the plant material. Thanks to the water jet pressure, the glandular trichomes can be dislodged from the plant surface. The pressure of the water jet is determined so as to not damage the plant material being extracted on the spray-table 3.

The spray-array 2 may be provided with an on/off valve 26, which can be opened by the operator when pressurized water is required, and closed at the end of the process. The valve 26 may be manually actuated or actuated by the means of an electrical system. Alternatively or in addition, a pump command 27 may be included or connected to the apparatus 1, so as to allow the user to activate and stop the pump 23.

The spray-table 3, placed below the spray-array 2, comprises a rigid table frame 31, and a meshed surface 32. The table frame 31 may stand or be suspended by the means of spray-table links 33. The spray-table links 33 may be rigid or flexible, and have all the same length in such a way that the spray-table 3 is horizontal or substantially horizontal. The meshed surface 32, also designated as a porous screen, can be a synthetic surface stretched on the table frame 31. In particular, it can be a polyester or a nylon filter screen material, such as screen printing mesh. The meshed surface 32 has a calibrated porosity comprised between 200μ and 300μ micrometers. The porosity is ideally around 250μ micrometers, which is larger than the size of the glandular trichomes to be purified. Upon impact of the jet forced water, the integer glandular trichomes are thus dislodged from the pistils holding them and pass sieved from the plant material through the meshed surface 32 while the larger vegetal impurities remain on the meshed surface 32.

The spray-table 3 is placed horizontally at a distance from the spray-array 2 comprised between around 20 cm and 40 cm, preferably between 25 and 35 cm. A distance of around 30 cm is ideal. However, depending on the actual pressure and shape of the water jets, the distance may be adapted. The dimensions of the spray-table 3 may vary according to the amount of material to be purified. The spray-table 3 may for example firm a rectangular surface having its edge lengths comprised of between 150 and 250 cm. It can also be a surface having a width of around 240 cm and a depth of around 125 cm. Any other dimensions are also contemplated.

Below the spray-table 3 is placed a run-off device 4. The run-off device 4 is preferably a non-porous surface adapted to collect the glandular trichomes which are washed through the spray-table 3 with the cold water flow. In a particular embodiment, the run-off device 4 may be provided with lips 41 on its edges to prevent spills of the flowing water. The run-off device 4 is advantageously provided with one or more gutter channels 42, allowing the run-off water flowing along the lips 41 to arrive in the gutter channel 42. The gutter channel 42 may be for instance placed at a corner of the run-off device 4. Although the run-off device 4 is to be a flat surface placed quasi horizontally below the spray-table 3, it is advantageously slightly inclined so as to facilitate the water flow through the gutter channel 42. An inclination of up to <10°, or comprised between 5° and 10°, with regard to the horizontal reference, is advantageously considered. Thus, the water flow does not remain in the run-off device 4. In addition, the water flow, accelerated by the inclination of the run-off device 4, allows all of the water to flow out of the run-off device 4. The run-off device 4 may be suspended by several run-off device links 43. The run-off device links 43 may be rigid or flexible. All the run-off device links 43 may have different length values in order to allow the run-off device 4 adopt the proper inclination. Alternatively, or in addition, one or more of the links 43 may be provided by an adjustment means 44 to adapt the length of the corresponding run-off device link 43 delivering the resin rich water flow into the sieving device 5 below.

Alternatively, the run-off device 4 may be a conical surface surrounded by a lip 41, and provided with a gutter channel 42 at its lowest point. As above, the inclined surfaces of the run-off device 4 allow the water flow to spill out of the run-off device 4 through the gutter channel 42. In this configuration, the gutter channel 42 is placed below the wash flow surface of the run-off device 4.

The run-off device 4 may be made of any hard material such as glass, plastic, polymer material or metallic material. The wash flow surface of the run-off device 4 can alternatively be made of a flexible non-porous material stretched on a frame.

The dimensions of the run-off device 4 are slightly larger than the corresponding dimensions of the spray-table 3 above, in such a way that all the water flow passing through the spray-table 3 falls to the run-off device 4 for a gravity dispatch to the sieving device 5 from one out flow point of the gutter channel 42.

The spray-array 2 comprises one or more fixation means 7, so as to be suspended to an upper frame (not shown) or the ceiling. Fixation means 7 are preferably flexible, such as cables, iron wire, or any other equivalent flexible fixation means. Such a flexible fixation allows the operator to easily translate the spray-array 2 back and forth on a horizontal plan, so as to direct the water jets all over the surface of the spray-table 3. A sweeping motion can thus easily be operated to wash off most all resin glands from the material placed on the spray-table 3. If not flexible, the fixation means 7 may be articulated is such a way to allow the lateral/horizontal sweeping motion according to one or two horizontal axes.

Alternatively, the fixation means 7 may be provided with one or more guides which allow a horizontal motion, such as a beam or a rail, or a track.

Alternatively, or in addition, the fixation means 7 are elastic or comprise an elastic portion, so as to allow movement the spray-array 2 along a horizontal plane perpendicular to the spray table. To this end, the fixation means 7 may be provided with a spring 8 or any equivalent elastic element such as rubber. Any equivalent mechanical arrangement may also be used. The elastic properties of the fixation means 7 make it possible to optimize the distance of the nozzles 21 with regard to the spray-table 3, so as to modulate the strength of the water jets on the plant material to be processed. It is clear that the hose 29*a* should have the sufficient flexibility to allow the motion of the spray-array 2.

The dimensions of the spray-array 2 may be the same as the corresponding dimensions of the spray-table 3 if the spray array is to be fixed and provided with sufficient water jets to cover the full extraction surface of the spray table 3. If spray-array 2 is alternatively of smaller dimensions with regard to the spray-table 3, then the spray array 2 is mobile allowing the operator to move the water jets such as to impact in a sweeping motion the materials on the spray-table 3. Its sweeping motion allows anyway to cover the full surface of the spray-table 3. The spray-array 2 is ideally sized between 45 cm square and/or 35 cm by 60 cm rectangular. Here, the dimensions of the spray-array 2 and the spray-table 3 denotes the length and the width of the spray-array 2 and the spray-table 3 on a horizontal plane.

The apparatus of the present invention also comprises a collection unit C. The collection unit C is placed at the lowest point of the spray extraction unit E below the gutter channel 42 of the run-off device 4. The collection unit C comprises several screens 51 disposed one below each other. The water flowing out the run-off device 4 successively crosses the screens 51 in a vertical direction, driven by the gravity. Each screen 51 has a reduced pore size from the upper one to the lowest one. For example, an upper sieving screen 51*a* may have a pore sized of 220μ microns. Ideally, the pore size of the upper sieving screen is less than 250μ micrometers. The pore size of a second sieving screen 51*b*, placed below the upper sieving screen 51*a*, may be comprised between 200μ and 175μ micrometers. Ideally, the pore size of the second sieving screen 51*b* is around 190μ micrometers. The pore size of a third sieving screen 51*c*, placed below the upper sieving screen 51*b*, may be comprised between 175μ and 150μ micrometers. Ideally, the pore size of the third sieving screen 51*c* is around 160μ micrometers. The pore size of a fourth sieving screen 51*d*, placed below the upper sieving screen 51*c*, may be comprised between 150μ and 115μ micrometers. Ideally, the pore size of the fourth sieving screen 51*d* is around 120μ micrometers. The pore size of a fifth sieving screen 51*e*, placed below the upper sieving screen 51*d*, may be comprised between 110μ and 80μ micrometers. Ideally, the pore size of the fifth sieving screen 51*e* is around 90μ micrometers. The pore size of a sixth sieving screen 51*f*, placed below the upper sieving screen 51*e*, may be comprised between 80μ and 65μ micrometers. Ideally, the pore size of the sixth sieving screen 51*f* is around 73μ micrometers. The pore size of a seventh sieving screen 51*g*, placed below the upper sieving screen 51*f*, may be comprised between 65μ and 35μ micrometers. Ideally, the pore size of the seventh sieving screen 51*g* is around 45μ micrometers. The pore size of an eighth sieving screen 51*h*, placed below the upper sieving screen 51*g*, may be comprised between 35μ and 1.5μ micrometers. Ideally, the pore size of the eighth sieving screen 51*h* is around 25μ micrometers. The number of the sieving screens and their pore size may easily be tuned according to the size of the integer resin glands to be processed. The number of the sieving screen can be in particular comprised between 4 and 20 or more.

Figure 2:
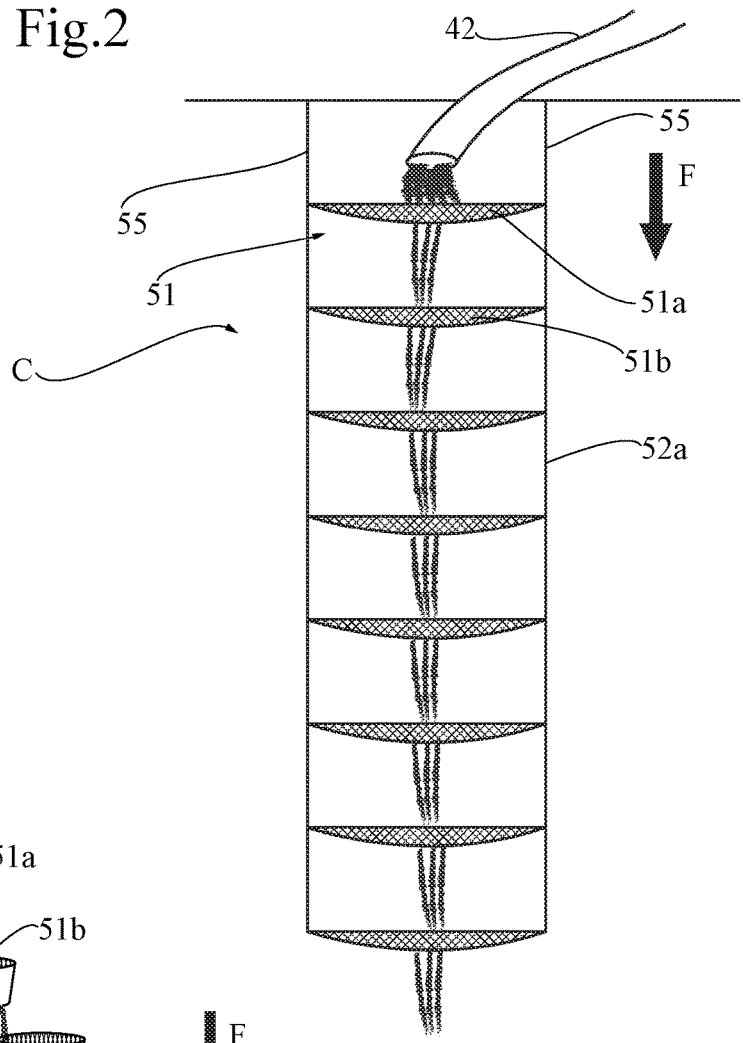
FIG. 2 shows the details of the sieving and collection unit according to a first embodiment.

In one embodiment, the collection unit C comprises a frame 52*a*, which is suspended below the gutter channel 42 by the means of collection unit links 55. If suspended, the frame 52*a* may be suspended to the run-off device 4, or to another part of the extraction unit E, or even to the ceiling. The frame 52*a* maintains several sieving screens one below each other, as shown in FIG. 2. The pore size of the sieving screens is reduced along the vertical water flow F. As the water flow crosses the screens the mesh selects out the diverse sizes of the integer glandular trichomes and retains those on the screens when they are larger than the pore size opening of the mesh. The glandular trichomes are thus retained all along the sieving screens placed in digressive pore size order, each screen will retain those integer glandular trichomes larger than its particular mesh opening. Those integer glandular trichomes being of smaller size are washed through the screen to be caught in a subsequent smaller screen. The final screen may have a mesh size of only 15μ micrometers, to note the passage of water through the very fine mesh openings is much slower than the passage of water through the filter screens of larger mesh openings. Smaller than 45μ micrometers the glandular trichomes are probably partial and not integer. There is absolutely very little plant vegetation as contaminant present in the water.

The screen shape 52*a* may be square or round. It is advantageously hung in such a way as to remain open with a low point in the center. Such a hanging frame 52*a* is particularly useful when the collection unit C needs to be installed and removed regularly and carried to different places. It is also an advantage when the collection unit C is sold and sent to clients. A compact shape allows for easy travel and to reduce shipping costs. When the frame 52*a* is collapsible, the collection unit C can for example be suspended in such a way that the sieving screens 51 are straight above and below each other.

Figure 3:
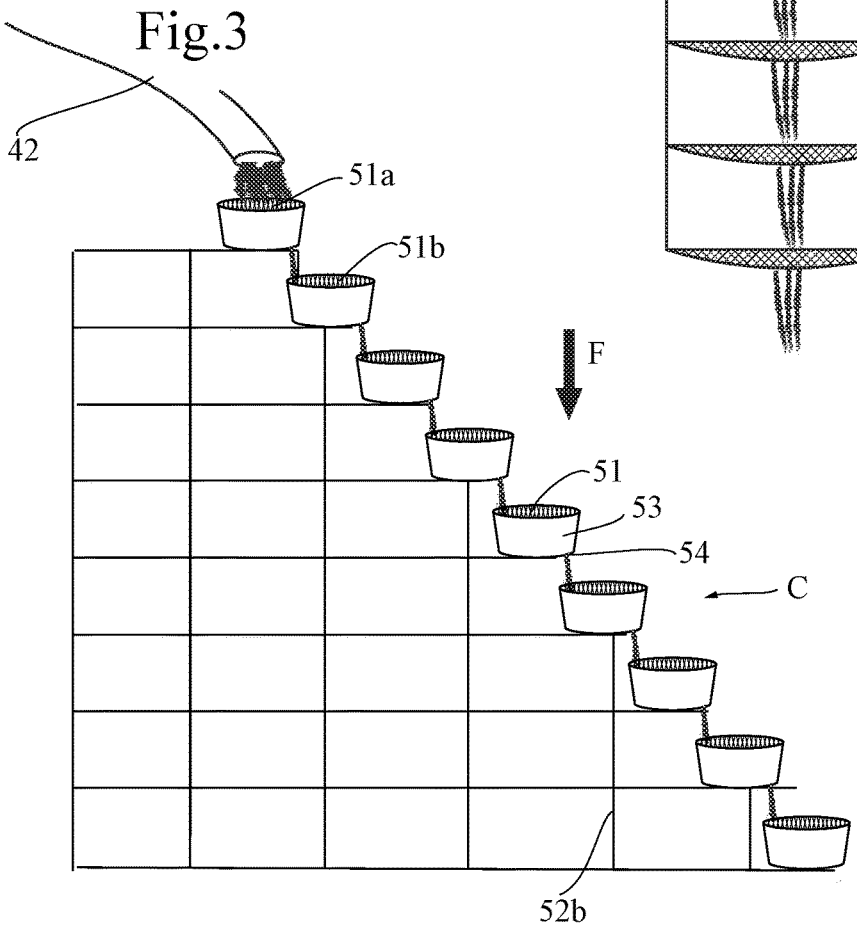
FIG. 3 shows the detail of the sieving and collection unit according to a second embodiment.

In another embodiment, the collection unit C comprises a rigid frame 52*b* standing below the gutter channel 42 of the extraction unit E. The frame 52*b* maintains several basins covered with sieving screens off-set in steps below each other. The frame 52*b* may be made of wood, metal or hard plastic or any other combination rigid materials. The basins, stretched with the filter screens, placed on the frame 52*b* are removable for an easy set up and adjustment of the flow. Each basin 53 has a sieving screen stretched over it, the bottom of which is provided with a hole 54. With a flat base basin, it can also be tilted to focus the flow from the hole on its edge, as shown in FIG. 3, the basin is inclined on the cascade step. In this way, the water flow forms a cascade wherein the sieving screens 51 are offset from each other. The integer glandular trhichomes are thus retained on the top of all the sieving screens the pore size of which is smaller than the size of the glandular trichomes collected. Any dust, small broken glandular trichomes or impurities being of smaller size are washed off through the screen.

Whether the collection unit C is suspended or comprises a standing frame 52*b*, it can be optionally embedded in a refrigerated work area, not shown, in such a way that the water does not warm up, or does not significantly warm up, during the extraction, isolation and collection process.

The spray-array 2, spray table 3, the run-off device 4 of the extraction unit E, and the sieving screens of the collection unit C, are thus arranged each one below the other, so as to allow a fast cascade process, wherein the glandular trichomes rich water successively crosses the meshed surfaces having progressively reduced hole size, in a vertical or substantially vertical flow F. The water flow F is preferably comprised between 0.8 and 1.5 liters per second. Filter screens with mesh openings below 80μ micrometers might need more surface area to maintain a smooth flow.

For a batch process, a given amount of fresh, unsprayed, glandular trichomes bearing raw plant materials may be placed on the spray-table 3 at the beginning of the ten-minute spray extraction, isolation and collection process and wherein the material is washed out before initiating another batch of plant materials. Alternatively, the spray-table 3 may be replaced by a porous conveyor belt dispatching raw plant materials and slowly moving the plant material under the nozzles 21.

The purified and size isolated resin may be collected on the tops of the sieving screens of the collection unit C after just a few seconds, for a better preserved integer resin gland it is better to remove the collected glandular trichomes from the ongoing flow of water coming down from the spray extraction table 3 above. The rapid cascade and removal from the cold water reduces the dissolution of soluble components and thus provides a high quality isolated product. In particular, the water-soluble terpenes are preserved within the isolated integer resin glands.

After the water has passed through the cascade of the collection unit C the water may then be collected for further treatment, or simply sent to the drain.

The present invention also encompasses a kit comprising one or both of the extraction unit E and the collection unit C. In particular, a kit according to the present invention may comprise a spray-array 2, a spray-table 3, a run-off device 4, and a collection unit C, as described here before. The spray-array 2 is provided with a fixation means 7 so as to be suspended. The input I of the kits manifold 28 can easily be connected to a cold-water source and a delivery system able to channel an adequate amount of water at the prescribed temperature and pressure. The spray-table 3 and the run-off device 4 in the kit of the present invention are both available with their optional suspension means 33 and 43.

After the process the collected integer glandular trichomes resin can be frozen or stored at low temperature.

The purification process according to the present invention comprises the following steps:

a) Placing the resin rich plant material to be worked on an extraction unit E, comprising a spray-table 3, provided with a porous screen 32. The size of the openings of the porous screen 32 is higher than the size of the targeted integer glandular trichomes to be collected. The hole size of the screen 32 of the spray-table 3 is around 250 micrometers.

b) Directing at least one cold pressurized water jet toward the resin rich plant material, so as to spray off and remove with water the integer resin glands from the material spread across the spray-table 3.

c) Collecting the removed glandular trichomes suspended in the water flowing through the porous screen 32 of the spray-table 3 and onto a non-porous run-off device 4, placed directly below the spray-table 3.

d) Directing the water flow, comprising the resin glands from the run-off device 4, to a collection unit C, comprising several sieving screens 51 positioned horizontally one below the other, in such a way that the flowing stream of resin rich water successively crosses the sieving screens 51, descending by gravity in just a few seconds through the sieving unit 5.

e) Collecting the purified glandular trichomes captured on those sieving screens having a mesh opening which is smaller than the size of the integer glandular trichomes.

The collection process may be performed using the arrangement described herein, or using a different cascading arrangement, provided that several sieving screens of progressively reduced pore size are used. One or more of the process steps may be automated. A continuous process may be set up using a porous conveyor belt instead of the spray-table 3. Also, the collection and removal of the purified glandular trichomes from the various sized screens of the sieving unit may be automated by regularly swipe scratching off to the side, or washing off to the side with a water jet, the resinous glands collected on the sieving screens.

An illustrative example is described here below:

A spray-table 3 of approximately 3 square meters is used, stretched with a single piece of 250 micrometers opening nylon mesh. For one batch 500 liters of 2.5 bar pressurized cold water at a temperature of about 0.5° C. is sprayed for ten minutes over 4000 grams of loose dried flowers free from wood, dispatched on the spray-table 3. Half way through the batch, after four to five minutes or 250 liters of water, the operator stops spray flow and the half processed plant materials are turned over with a soft plastic rake, requiring about one minute, and then sprayed again for four to five minutes by another 250 liters of pressurized cold water. When this batch process is repeated 4 times with 4000 grams of dry plant material in each batch, this process allows the operator of the spray levels 2 and 3 to purify 16 kilograms of dry plant material in roughly one hour. Below the spray levels 2 and 3 the operator at the purification and collection level 5 can collect 1600 to 2400 grains of glandular trichomes in one hour.

The invention claimed is:

1. A process for extracting and collecting pure integer glandular trichomes, the process comprising the steps of:

a) placing plant material to be purified on an extraction unit;

b) directing at least one pressurized cold water jet toward the plant material, so as to dislodge the glandular trichomes from the plant material and to produce a resin-rich water flow with the dislodged glandular trichomes;

c) collecting the resin rich water flow crossing the porous screen to a non-porous run-off device of the extraction unit;

d) directing the water flow, comprising the resin glands from the run-off device, to a collecting unit, placed below the run-off device of the extraction unit, the collecting unit comprising a sieving unit, wherein the sieving unit comprises several sieving screens positioned horizontally one below the other and having a hole size decreasing from an upper sieving screen to a bottom sieving screen, in such a way that the flowing stream of resin rich water successively crosses the sieving screens, descending by gravity through the sieving unit; and e) collecting purified integer glandular trichomes on all of the sieving screens in which a hole size is lower than the size of those integer glandular trichomes passing in the water flow.

2. The process of claim 1, wherein said extracting unit comprises a spray-table provided with a porous screen, the hole size of said porous screen being higher than the size of the glandular trichomes to be processed.

3. The process according to claim 1, wherein said cold water is provided at a temperature comprised between 0.5° C. and 2.5° C.

4. The process according to claim 1, wherein said cold water is provided at a pressure comprised between 2.5 and 3.5 bars.

5. The process according to claim 2, wherein the spray-table is horizontal, and wherein several pressurized cold water jets are directed toward the spray-table.

6. The process according to claim 1, wherein several pressurized cold water jets are provided by the mean of nozzles, connected to a manifold, which is fed by pressurized cold water in a flexible hose.

7. The process according to claim 1, wherein the water is pressurized by the means of a pump and stored in a pressure tank placed upstream from the manifold and nozzles.

8. The process according to claim 1, wherein the run-off device is a flat inclined surface provided with lips at its edges and a gutter channel at its lowest part.

9. An apparatus comprising:

an extraction unit, comprising:

a spray-array, a spray-table provided with a porous screen, a non-porous run-off device placed below the spray-table and under the porous screen, wherein the non-porous run-off device is provided with lips and a gutter channel, and a collection unit comprising a sieving unit placed below the gutter channel of the run-off device, wherein the sieving unit comprises sieving screens which hole size decreases from an upper sieving screen to a bottom sieving screen.

10. The apparatus according to claim 9, wherein said spray-array comprises a manifold and several nozzles, and wherein the nozzles are connected to the manifold by the mean of ducts, so as to be fed with pressurized cold water.

11. The apparatus according to claim 9, wherein the spray-array is suspended above the spray-table by a flexible means in such a way to be moved back and forth by an operator, to orient the water jets and adapt the proper distance between the water jets and all parts of the spray-table.

12. The apparatus according to claim 9, wherein the hole size of the porous has a screen mesh opening of 250 μmicrometers.

13. The apparatus according to claim 9, wherein the sieving unit comprises between 4 and 20 sieving screens placed one below the other, and wherein the hole size of the sieving screens decreases from the upper sieving screen to the bottom sieving screen.

14. The apparatus according to claim 9, further comprising:

a refrigerated pressure tank, wherein the cold water is maintained at 2.5 BAR and a temperature comprised between 0.5 and 2° C.

15. The apparatus according to claim 9, further comprising:

a command system adapted to activate and stop the water flow supplied to the spray array of the extraction unit.

16. A kit comprising:

a spray-array, a spray-table provided with a porous screen, a non-porous run-off device with lips and a gutter channel placed below the spray-table and under the porous screen, and a collecting unit comprising a sieving unit placed below the gutter channel of the non-porous run-off device, wherein the sieving unit comprising sieving screens which hole size decreases from an upper sieving screen to a bottom sieving screen.

17. The kit according to claim 16, wherein the spray-table comprises:

a spray-table frame, and several spray-table links to be suspended.

18. The kit according to claim 16, wherein the run-off device comprises a flat non-porous surface comprising edges with lips and a gutter channel, and wherein the run-off device further comprises several run-off device links so as to be suspended in such a way that the run-off device can be inclined.

19. The kit according to claim 16, wherein the collection unit comprises a series of hanging sieving screens in a vertical stack.

20. The kit according to claim 16 wherein the collection unit further comprises of a cascade array on a rigid frame.

* * * * *